US005174051A

United States Patent [19]

Walkhoff et al.

[11] Patent Number: 5,174,051

[45] Date of Patent: Dec. 29, 1992

[54] SKI BOOT WITH A REAR CLOSING DEVICE

[75] Inventors: Klaus Walkhoff; Andreas Germann, both of Kreuzlingen, Switzerland

[73] Assignees: Raichle Sportschuh AG, Kreuzlingen, Switzerland; Icaro Olivieri & C., Montebelluna, Italy; a part interest to each

[21] Appl. No.: 655,756

[22] Filed: Feb. 14, 1991

[30] Foreign Application Priority Data

Feb. 21, 1990 [CH] Switzerland ..... 555/90

[51] Int. Cl.[5] ..... A43B 11/00

[52] U.S. Cl. ..... 36/117; 36/50.5

[58] Field of Search ..... 36/117–121, 36/50; 24/68 SK, 69 SK, 71 SK

[56] References Cited

U.S. PATENT DOCUMENTS

| | | | |
|---|---|---|---|
| 4,619,057 | 10/1986 | Sartor et al. | 36/117 |
| 4,631,839 | 12/1986 | Bonnetti et al. | 36/117 |
| 4,727,627 | 3/1988 | Baggio et al. | 36/50 |
| 4,870,723 | 10/1989 | Pozzobon et al. | 24/68 SK |
| 5,065,481 | 11/1991 | Walkoff | 24/68 SK |

FOREIGN PATENT DOCUMENTS

| | | | |
|---|---|---|---|
| 230879 | 8/1987 | European Pat. Off. . | |
| 2564711 | 11/1985 | France | 36/119 |
| 1187424 | 6/1985 | Italy . | |

*Primary Examiner*—Paul T. Sewell
*Assistant Examiner*—Thomas P. Hilliard
*Attorney, Agent, or Firm*—Collard & Roe

[57] ABSTRACT

A sport shoe, such as a ski boot, has a rear shaft part which can be pivoted backwards for putting on the ski boot. On this rear shaft part a tensioning device for a band is arranged, which band is anchored by means of its two ends on a front shaft part. The tensioning device has a take-up drum for the band which is connected to a drive shaft via a shiftable splined coupling. To rotate the drive shaft, a tensioning lever which can be pivoted to and fro, is connected to the drive shaft by a grip-roller freewheel coupling. A return rotation of the drive shaft is prevented by means of a return lock. The drive shaft and the return lock are accommodated in a housing which is displaceable, in its longitudinal direction, in relation to the rear shaft part. To release the take-up drum for the purpose of unwinding the band, the splined coupling is uncoupled by displacing the housing in relation to the take-up drum which is held in its position by a support bar.

16 Claims, 7 Drawing Sheets

Fig. 5
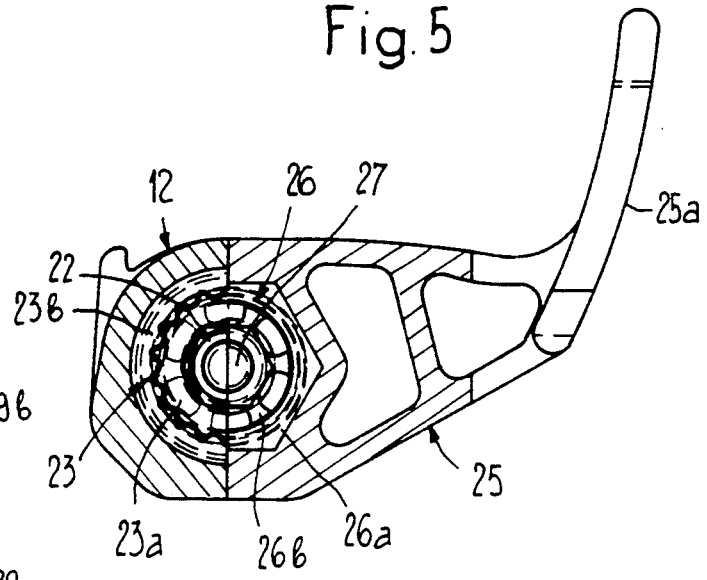
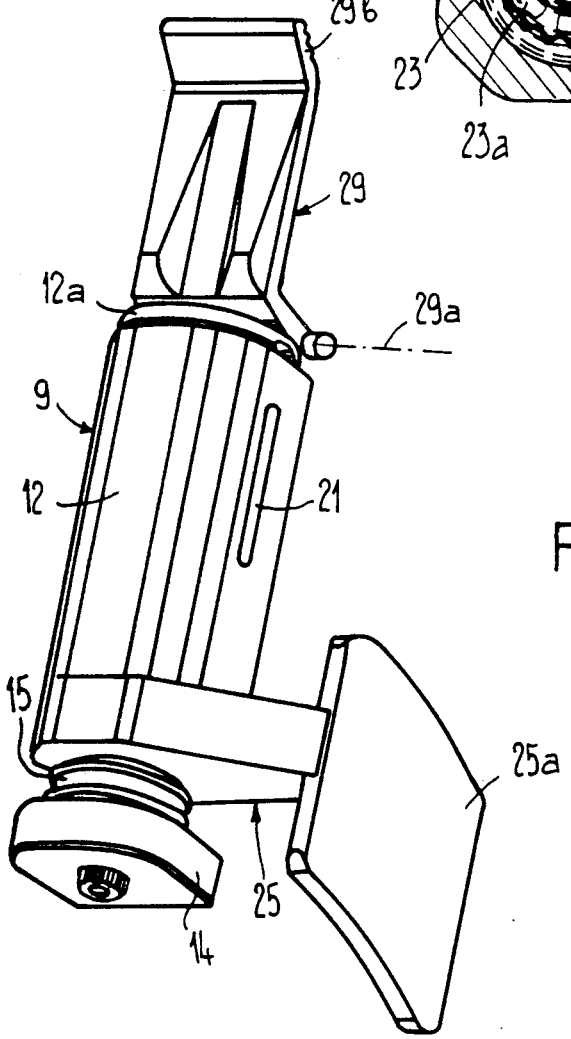
Fig. 3

SKI BOOT WITH A REAR CLOSING DEVICE

BACKGROUND OF THE INVENTION

1. Field of the Invention

The present invention relates to a sport shoe and in particular a ski boot.

2. The Prior Art

It is known from Italian Patent No. 1,187,424, to have such a ski boot with two shaft parts, which are movable relative to one another. There is also a closing device for the detachable connection of these two shaft parts, which is formed by a tensioning device, which is arranged on one, first shaft part, and a band or cable, which engages on the other, second shaft part. The band or cable can be tensioned by means of the tensioning device.

SUMMARY OF THE INVENTION

It is an object of the present invention to produce a sport shoe, in particular a ski boot, of this type, the closing device of which makes possible, using the simplest possible construction, comfortable closing and quick opening of the boot.

The above object is accomplished in accordance with the present invention by providing a sport shoe, in particular a ski boot, comprising a sole, an upper shaft region attached to said sole which is intended to enclose a leg of a wearer and said region having two shaft parts which are movable relative to one another, a closing device for the detachable connection of the two shaft parts which comprises a tensioning device which is arranged on a first one of said two shaft parts, and a band or cable, which engages on the other second shaft part, said band or cable being tensioned by said tensioning device, and said tensioning device having the following parts: an oblong housing which is arranged on the first shaft part and which is displaceable, in its longitudinal direction as the direction of displacement, in relation to the first shaft part against the action of an elastically deformable return element, a take-up drum for the band or cable, which drum is accommodated and rotatably mounted in the housing and is displaceable, in the direction of its longitudinal axis, relative to the housing, a drive shaft which is coaxial with the take-up drum and mounted rotatably in and displaceably with the housing, a shift coupling which couples the drive shaft to the take-up drum, a return lock accommodated in the housing for the drive shaft, a tensioning lever which can be pivoted to and fro, being connectable to the drive shaft, a tensioning lever coupling for connecting the tensioning lever to the drive shaft, said coupling active in the direction of tensioning, and is displaceable with the housing, and means for bringing about a relative movement between the take-up drum and the housing on displacing the housing to free the shift coupling.

Closing of the boot, that is to say tensioning of the band or cable, is carried out by pivoting the tensioning lever to and fro, a practically continuous tensioning being possible by virtue of the special design of the coupling between the tensioning lever and the drive shaft.

Opening of the boot, that is to say loosening of the band or cable, is carried out in a simple manner by displacing the housing, the displacement of which results in a freeing of the shift coupling and thus a release of the take-up drum. The two shaft parts can then be moved away from one another easily by unwinding the band or cable from the take-up drum.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing, wherein similar reference characters denote similar elements throughout the several views:

FIG. 3 shows in a perspective view the tensioning device removed from the boot and in the state of releasing the band;

FIG. 5 shows a cross-sectional view along the line IV—IV in FIG. 4;

DETAILED DESCRIPTION OF PREFERRED EMBODIMENTS

Figure 1:
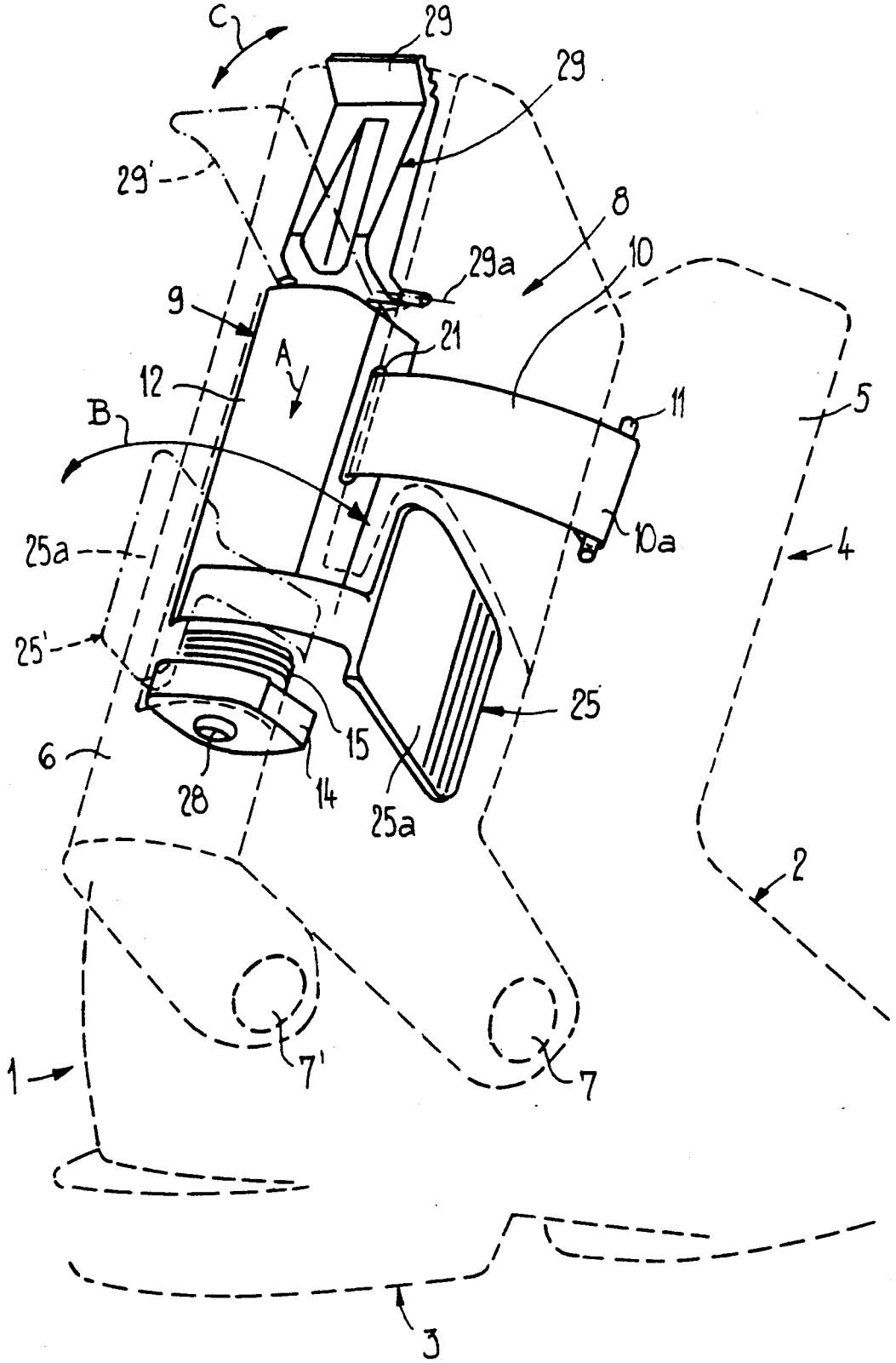
FIG. 1 shows in perspective the rear part of a ski boot with a closing device.

Turning now in detail to the drawings, FIG. 1, in broken lines, shows the rear part of a ski boot 1, the shaft and sole of which are indicated by 2 and 3 respectively. The upper shaft region 4 is formed by a front shaft part 5 and a rear shaft part 6. The rear shaft part 6 is connected in an articulated manner to the lower part of the boot shell by means of two articulations 7, 7' which, in relation to the central plane of the boot, lie opposite one another. To put the boot 1 on, the rear shaft part 6 (spoiler) can be pivoted backwards in known manner. The cushioned inner boot arranged inside the boot shell is not shown in FIG. 1.

The two shaft parts 5 and 6 can be interconnected by means of a closing device indicated by 8. This closing device 8 has a tensioning device 9, which is arranged on the rear shaft part 6, and a band 10 which can be tensioned by said tensioning device and which is anchored at its ends in two places on the front shaft part 5, which, in relation to the central plane of the boot, lie opposite one another. To this end, the band 10 has at its ends (of which only one end 10*a* is visible in FIG. 1) a loop, through which an anchoring pin 11 runs, which is connected, in a manner not represented in greater detail, to the front shaft part in the form of a snap connection.

The tensioning device 9 has an oblong housing 12 which is arranged displaceably in its longitudinal direction, that is to say in the direction of the arrow A, on the rear shaft part 6. Between the housing 12 and an anchoring plate 14, which is fastened to the rear shaft part 6, a bellows 15 is arranged as a cover.

Inside the housing 12, a take-up drum 16 for the band 10 is arranged, which is mounted rotatably in the housing 12 by means of bearing parts 17, 17' (FIGS. 4 and 6). the take-up drum 16 is secured against a co-displacement with the housing 12, as will be explained more precisely below. This displacement of the housing 12 takes place against the action of a compression spring 18 which is arranged between the upper bearing part 17 and the housing cover 12*a*. The take-up drum 16 is provided with a slot 19, through which the band 10 extends. The band 10 runs on through lateral slots 20 and 21 in the housing 12. In the housing 12, a hollow drive shaft 22 is also accommodated, which is arranged coaxially with and below the take-up drum 16. This drive shaft 22 is mounted rotatably in the housing 12 and is co-displaceable with the housing. The coupling between drive shaft 22 and take-up drum 16 takes place via a shiftable splined coupling 23 (also known among experts under the name Jaccard coupling). The internal part 23*a* of this coupling 23 has external teeth and is connected to the take-up drum 16, that is to say designed in one piece with its lower bearing part 17'. The other coupling part 23*b*, which accordingly has internal teeth, is seated on the drive shaft 22 and co-rotates with the drive shaft.

Below the coupling 23, a return lock 24 for the drive shaft 22 is arranged in the housing 12, which return lock is designed as a grip-roller freewheel. The external part of this return lock 24, which is connected in a rotationally fixed manner to the housing 12, is indicated by 24*a*, while the internal part, which is located on the drive shaft 22, is indicated by 24*b*. The return lock 24 is advantageously designed as an external freewheel.

To rotate the drive shaft 22, and thus the take-up drum 16, a tensioning lever 25 is provided, which is displaceable with the housing 12. This tensioning lever, the handle part of which is indicated by 25*a*, can be pivoted to and fro in the direction of the arrow B (FIG. 1; between two end positions. In the rest position, which is represented in FIG. 1 in solid lines, the tensioning lever 25 bears against the outside of the rear shaft part 6, a spring (not represented) ensuring that the tensioning lever 25 remains in this rest position. The other end position of the tensioning lever 25 is illustrated in FIG. 1 in dot-dash lines and indicated by 25'. The tensioning lever 25 is connected to the drive shaft 22 via a grip-roller freewheel coupling 26. The external part of this grip-roller freewheel coupling 26, which is advantageously designed as an external freewheel, is indicated by 26*a* and connected to the tensioning lever 25 in a rotationally fixed manner. The internal part of this coupling, which is located on the drive shaft 22, is indicated by 26*b*. On pivoting the tensioning lever 25 from the rest position into the end position 25' which is represented in dot-dash lines in FIG. 1, a carrying along of the drive shaft 22 takes place via the coupling 26, which accordingly results in a rotary movement of the take-up drum 16. On the return movement of the tensioning lever 25 into the rest position, the coupling 26 exerts its freewheel action, the return lock 24 preventing a return rotation of the drive shaft 22.

The return lock 24, which is designed as a grip-roller freewheel, and the grip-roller freewheel coupling 26 are per se of known construction. For this reason, a further description of the construction and the function of these two components is not provided.

Through the hollow drive shaft 22, a support bar 27 extends, which is in contact at the upper end 27*a* with the take-up drum 16 or the bearing part 17'. At its lower end 27*b*, the support bar 27 is fastened in the anchoring plate 14. By means of an adjusting screw 28, which is screwed into a sleeve 14*a* inserted in the anchoring plate 14, the support bar 27 can be adjusted in its position in relation to the anchoring plate 14. The function of this support bar 27 will be explained below.

Above the housing 12, an L-shaped release lever 29 is arranged, which is mounted in the rear shaft part 6 pivotably about an axis 29*a*. The pivot axis 29*a* runs essentially at right angles to the direction of displacement A of the housing 12. The release lever 29 can be pivoted to and fro between two end positions in the direction of the arrow C (FIG. 1). In the rest position, which is represented in FIG. 1 in solid lines, the release lever 29 bears against the boot. On pivoting the release lever 29 out of this rest position into the release position 29', which is represented in FIG. 1 in dot-dash lines, the release lever 29 comes to act on the cover 12*a* of the housing 12. It displaces this housing 12 together with the drive shaft 22, the return lock 24, the tensioning lever 25 and the grip-roller freewheel coupling 26 downwards (in the direction of the arrow A) against the action of the compression spring 18. The return of the release lever 29 takes place on the return of the housing 12 by the compression spring 18.

The function of the closing device 8 is now explained below.

Figure 2:
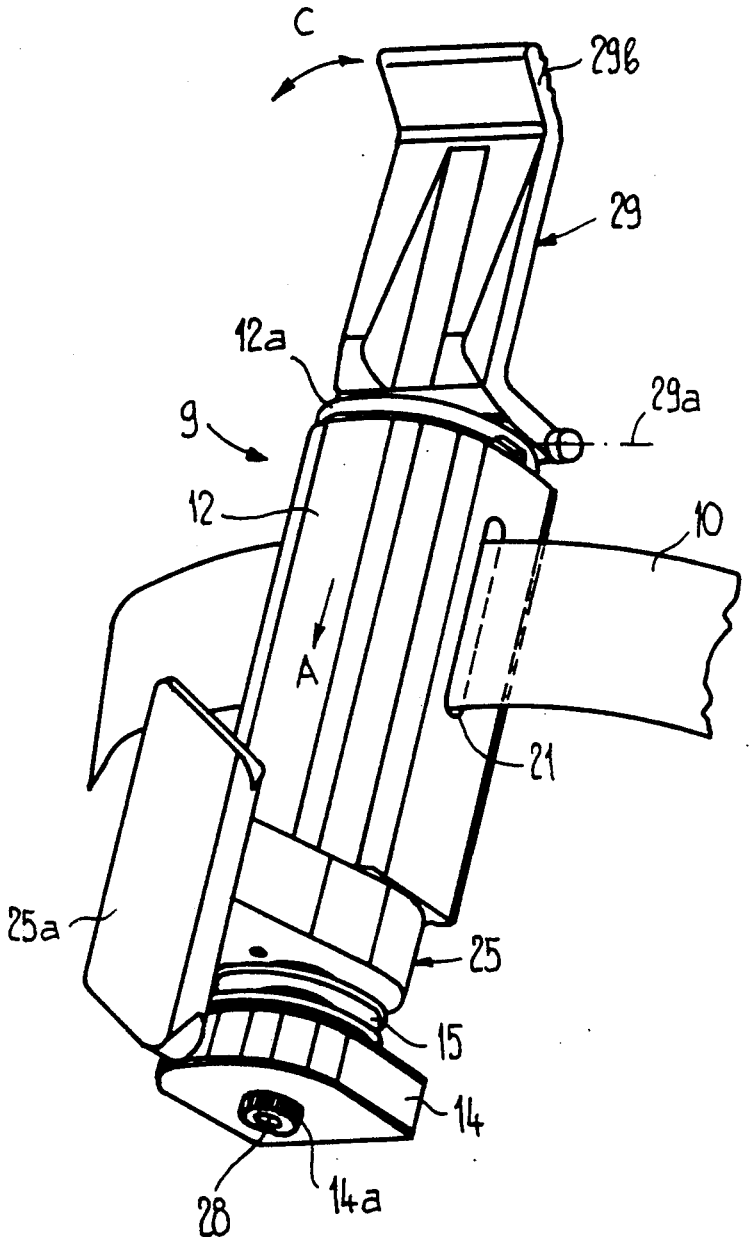
FIG. 2 shows in a perspective view the tensioning device removed from the boot and in the state of tensioning the band.
Figure 4:
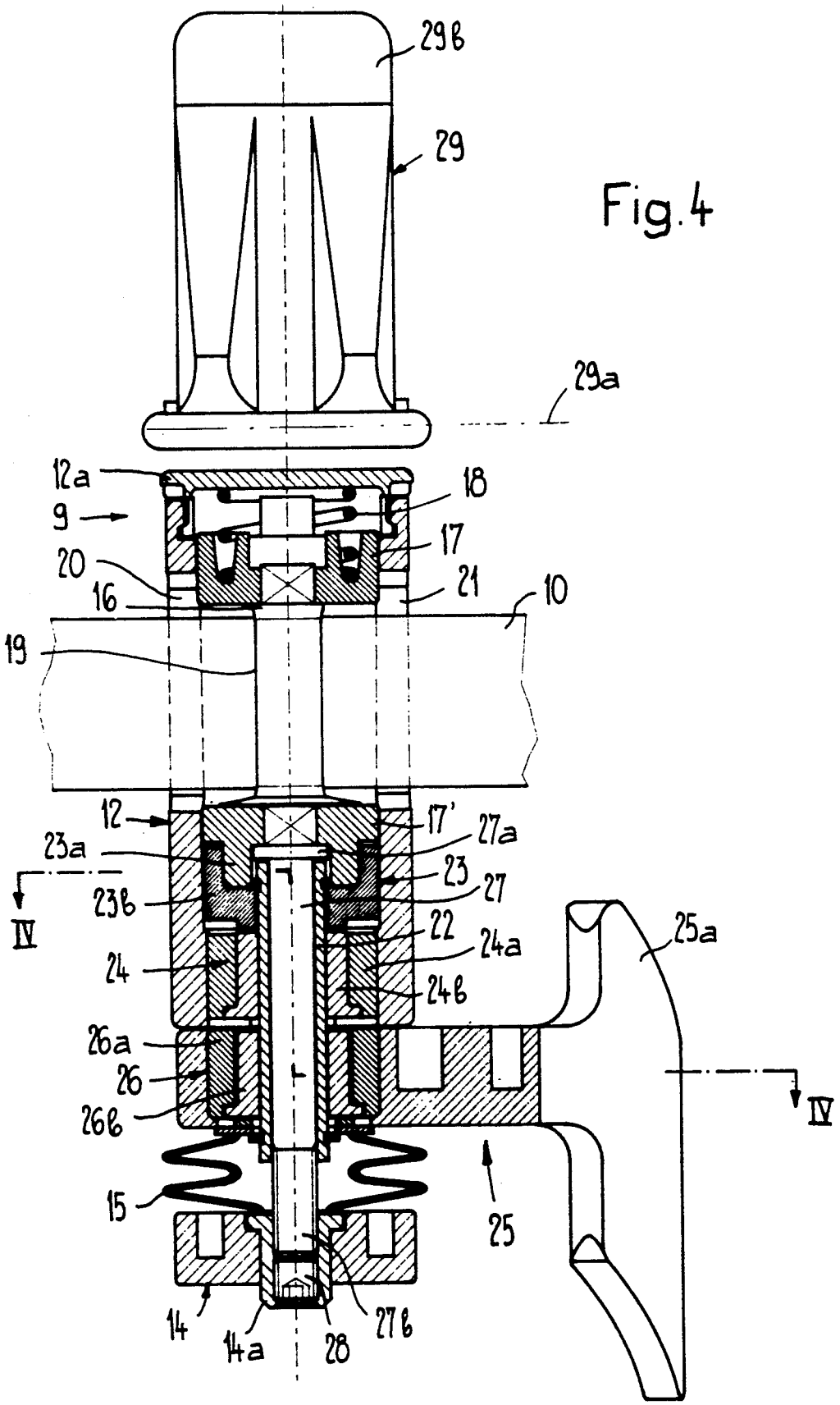
FIG. 4 shows in a longitudinal sectional view, a first embodiment of the tensioning device in the tensioning state.

The starting point is the open ski boot 1. In this state, the rear shaft part 6 is folded backwards fully and the band 10 is completely unwound from the take-up drum 16. The housing 12 is held in its upper end position by the compression spring 18 (FIGS. 1, 2 and 4). This means that the two parts 23*a*, 23*b* of the splined coupling 23 are in engagement with one another.

By means of repeated pivoting of the tensioning lever 25, the drive shaft 22 and thus the take-up drum 16 are then rotated stepwise, which results in the band 10 being wound up onto the take-up drum 16. As the band 10 is guided through the slot 19 in the take-up drum 16, a length compensation can be carried out, at the beginning of the closing process, between the two halves of the band, which, as already mentioned, are anchored at their ends 10*a* on the front shaft part 4.

Winding up of the band 10 onto the take-up drum 16 results in a shortening of the band sections which lead to the front shaft part 5. The rear shaft part 6 is then drawn evenly towards the front shaft part 5 and brought into contact with the lower leg of the wearer. The grip-roller freewheel coupling 26 makes possible a very fine adjustment of the tensile stress in the band 10. As already mentioned, the return lock 24 prevents a return rotation of the shaft 22 or of the take-up drum 16.

Figure 6:
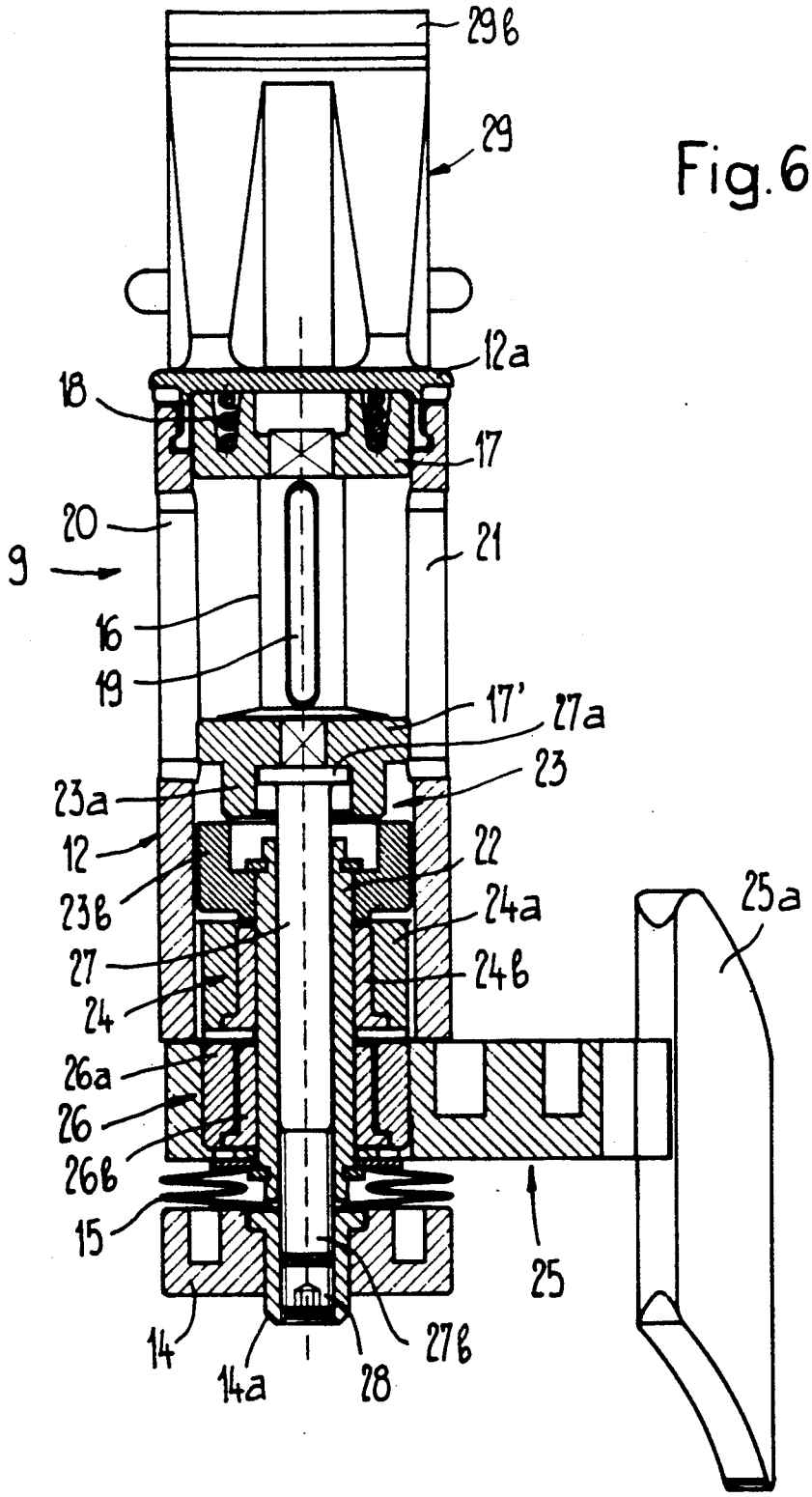
FIG. 6 shows the tensioning device in the release state in view corresponding to FIG. 4.

If the wearer then wishes to open the boot completely or partially, he presses with his hand or with the ski pole on the upper end 29*b* of the release lever 29 and pushes this downwards in the direction of the arrow C (FIG. 1) into the release position 29'. At the same time, the housing 12 together with the drive shaft 22, the return lock 24, the tensioning lever 25 and the grip-roller freewheel coupling 26 are displaced downwards in the direction of the arrow A (FIGS. 1, 2 and 6). At the same time, the compression spring 18 is compressed (FIGS. 3 and 6). The support bar 27, which is fastened on the rear shaft part 6 via the anchoring plate 14 and which, as already mentioned, acts upon the take-up drum 16 or its bearing part 17', prevents a carrying along of the take-up drum 16 during this downward movement of the housing 12. In other words, the take-up drum 16 remains in its position. This relative movement between take-up drum 16 and housing 12 together with the components 22, 23*b*, 24, 25 and 26, which are co-displaceable with it, then results in the two parts 23*a*, 23*b* of the splined coupling 23 being freed from one another (FIG. 6). That is to say the coupling 23 is uncoupled. The take-up drum 16 can then rotate freely, which makes possible an unwinding of the band 10. To this end, in addition to the pressing down of the release lever 29, a movement of the rear shaft part 6 backwards is necessary, which can be brought about by hand or by a corresponding movement of the lower leg of the wearer.

If the release lever 29 is released again, the housing 12 together with the components connected to it is pushed upwards again by the spring 18, which results in a coupling of the splined coupling 23. The tensioning device 9 is thus ready for a new tensioning operation.

In addition to returning the housing 12, the spring 18 also serves, in the tensioned state of the tensioning device 9, to hold the two parts 23*a*, 23*b* of the splined coupling 23 in engagement with one another.

Figure 7:
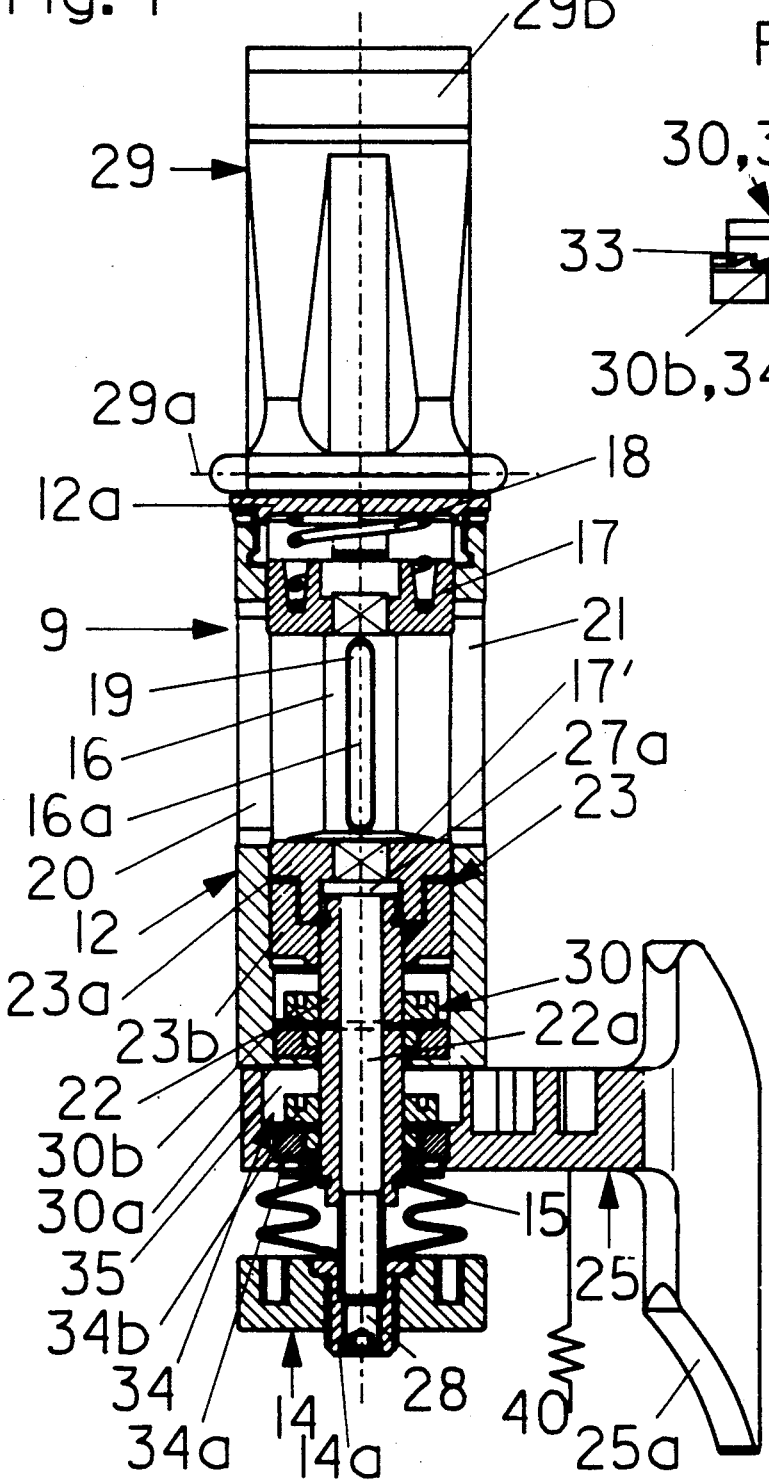
FIG. 7 shows a second embodiment of the tensioning device in the tensioning state in a view corresponding to FIG. 4.
Figure 8:
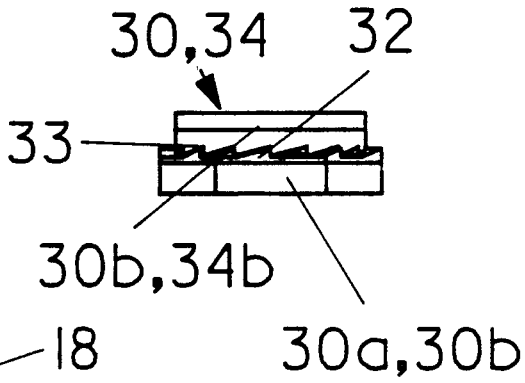
FIG. 8 shows, on enlarged scale in relation to FIG. 7, the couplings used in the tensioning device according to FIG. 7.
Figure 9:
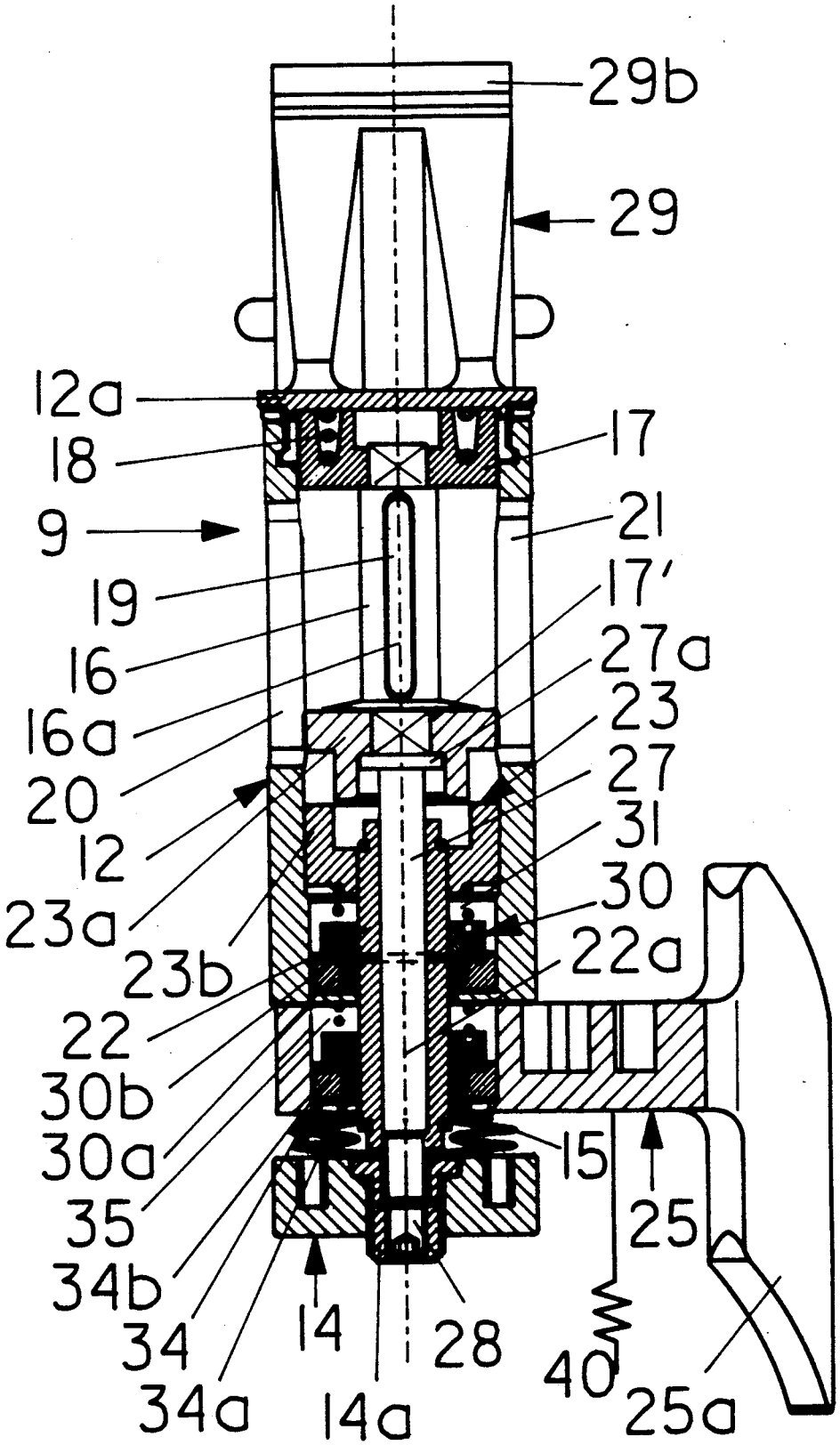
FIG. 9 shows the tensioning device according to FIG. 7 in the release state.

In FIGS. 7–9, a second embodiment of the tensioning device 9 is shown, the same reference numbers being used in these FIGS. 7–9 as in the FIGS. 4–6 for those components which correspond to components of the embodiment according to FIGS. 4–6.

The second embodiment according to FIGS. 7–9 is distinguished from the embodiment shown in FIGS. 4–6 by a different type of return lock 24 for the shaft 22 and a different coupling between the tensioning lever 25 and the shaft 22.

As FIGS. 7 and 9 show, between the shaft 22 and the housing 12, a return lock 30 is arranged, which has a part 30*a*, which is connected to the housing in a rotationally fixed manner, and a part 30*b* which is connected to the shaft 22 in a rotationally fixed manner. The latter part 30*b* is displaceable in the axial direction of the shaft 22 and is pressed against the coupling part 30*a*, which is fixed rigidly to the housing, by means of a compression spring 31. As FIG. 8 shows, the two coupling parts 30*a* and 30*b* have, on their mutually opposite end faces, teeth 32 and 33 respectively which, under the action of the compression spring 31, engage in one another. These teeth 32, 33 are designed in such a manner that, on a rotation of the coupling part 30*b* in one direction, they are freed from one another (freewheel action) but prevent a rotation in the opposite direction. In other words, the return lock 30 prevents a return rotation of the shaft 22 when the tensioning lever 25, as already described above, is moved back from the end position 25' represented in broken lines in FIG. 1. On tensioning, that is to say on a pivoting movement of the tensioning lever 25 from the rest position into the end position 25', however, the return lock 30 is not effective because, in this rotational direction, the coupling part 30*b*, which is displaceable in the axial direction of the shaft 22, is pushed back in each case against the action of the compression spring 31 and the teeth 32, 33 exert no locking action but continue to interact.

The coupling 34 between the tensioning lever 25 and the shaft 22 is per se constructed identically to the return lock 30 which has just been described. One coupling part 34*a* of the coupling 34 is mounted in a rotationally fixed manner with the tensioning lever 25. The other coupling part 34*b* is connected in a rotationally fixed manner to the shaft 22 but mounted displaceably in the axial direction of the latter on the shaft 22. The coupling part 34*b* is pressed against the other coupling part 34*a* by means of a compression spring 35 which is supported on the housing 12. As already described with reference to FIG. 8, the two coupling parts 34*a* and 34*b* are provided on their mutually opposite end faces with teeth 32, 33.

On tensioning, that is to say, on pivoting the tensioning lever 25 out of the rest position into the end position 25' represented in broken lines in FIG. 1, the teeth 32, 33 remain in engagement with one another. The result of this is that the shaft 22 and thus also the take-up drum 16 are rotated in the winding-up direction. On pivoting the tensioning lever 25 back into the rest position, the drive connection between the tensioning lever 25 and the drive shaft 22 is interrupted because the coupling part 34*b* is pushed back against the action of the compression spring 35 and the teeth 32, 33, as already described, are freed from one another.

As can be seen from FIG. 8, the described operation of the return lock 30 and of the coupling 34 is made possible by a corresponding saw-tooth-type design of the teeth 32, 33. Otherwise, the function of the closing device 8 provided with a tensioning device according to FIGS. 7–9 is the same as with reference to FIGS. 1–6.

Spring means 40 is a generic representation of a spring that is connected to the tensioning lever, and therefore holds the tensioning lever in its rest position.

The embodiments shown of the tensioning device 9 have the following advantages:

With the use of a grip-roller freewheel coupling 26 between tensioning lever 25 and drive shaft 22 (FIGS. 4–6), a fine adjustment of the tensile stress in the band 10 is possible. As the take-up drum 16, on winding up and unwinding of the band 10, always assume the same position in relation to the shaft parts 5, 6, no change takes place in the running path of the band 10 on tensioning or loosening. As a result of the arrangement of the take-up drum 16 above the tensioning lever 25 and the drive shaft 22, the take-up drum 16 can be arranged as high as possible, that is to say as close as possible to the upper edge of the rear shaft part 6. Closing of the two shaft parts 5, 6 can thus take place a long way up on the shaft.

While only two embodiments of the present invention have been shown and described, it is to be understood that many changes and modifications may be made thereunto without departing from the spirit and scope of the invention as defined in the appended claims.

What is claimed is:

1. A sport shoe, is particular a ski boot, comprising:

a sole;

an upper shaft region attached to said sole which is intended to enclose a leg of a wearer and said region having two shaft parts which are movable relative to one another;

a closing device for the detachable connection of the two shaft parts which comprises a tensioning device which is arranged on a first one of said two shaft parts, and a band or cable, which engages on the other second shaft part, said band or cable being tensioned by said tensioning device, and said tensioning device having the following parts:

an oblong housing which is arranged on the first shaft part and which is displaceable, in its longitudinal direction as the direction of displacement, in relation to the first shaft part against the action of an elastically deformable return element;

a take-up drum for the band or cable, which drum is accommodated and rotatably mounted in the housing and is displaceable, in the direction of its longitudinal axis, relative to the housing;

a drive shaft which is coaxial with the take-up drum and mounted rotatably in and displaceably with the housing;

a shift coupling which couples the drive shaft to the take-up drum;

a return lock accommodated in the housing for the drive shaft;

a tensioning lever which can be pivoted to and fro, being connectable to the drive shaft and being displaceable with the housing;

a tensioning lever coupling for connecting the tensioning lever to the drive shaft, said coupling being active in the direction of tensioning; and means for bringing about a relative movement between the take-up drum and the housing on displacing the housing to free the shift coupling.

2. The shoe as claimed in claim 1, wherein the return lock comprises a grip-roller freewheel.

3. The shoe as claimed in claim 1, wherein the tensioning lever coupling comprises a grip-roller freewheel coupling.

4. The shoe as claimed in claim 1, wherein the return lock has a first part which is arranged in a rotationally fixed manner in the housing, said return lock having a second part which is displaceable in a rotationally fixed manner with the drive shaft and in the direction of the longitudinal axis of the drive shaft;

said first part and said second part each having an end face and teeth on said end face, these teeth being in engagement with one another; and the second part being capable of being pushed away from the first part against the action of an elastic force on rotation of the drive shaft in the direction of tensioning

5. The shoe as claimed in claim 4, wherein the teeth are of saw-tooth shape.

6. The shoe as claimed in claim 1, wherein the shift coupling has a first shift coupling part which is connected to the tensioning lever in a rotationally fixed manner, and a second shift coupling part which is connected to the drive shaft in a rotationally fixed manner and can be displaced away from the first shift coupling part in the direction of the longitudinal axis of the drive shaft, against the action of a spring:

each coupling part having an end face and having teeth on its end face, said teeth being in engagement with one another; and the second shift coupling part being pushed back on rotation of the pivoting lever contrary to the direction of tensioning.

7. The shoe as claimed in claim 6, wherein the teeth are of saw-tooth shape.

8. The shoe as claimed in claim 1, which comprises a positive-lock shift splined coupling.

9. The shoe as claimed in claim 1, wherein the means for bringing about a relative movement between the housing and the take-up drum comprises a retaining element which is arranged on the first shaft part, acts on the take-up drum and retains the take-up drum on a displacement of the housing.

10. The shoe as claimed in claim 8, wherein the retaining element comprises a bar which is supported at one end on the first shaft part, said bar passing through the drive shaft and interacting at the other end with the take-up drum or with that part of the shift coupling which is connected to the take-up drum.

11. The shoe as claimed in claim 1, which comprises an operating member arranged on the first shaft part for displacing the housing.

12. The shoe as claimed in claim 11, wherein the operating member comprises a lever which is mounted on the first shaft part and can be brought to act on the housing and is tiltable about an axis which runs transversely to the direction of displacement of the housing.

13. The shoe as claimed in claim 1, wherein the band or cable is anchored on the second shaft part on mutually opposite sides of the second shaft part and is guided through a slot in the take-up drum.

14. The shoe as claimed in claim 1, further comprising a spring for holding the tensioning lever in its rest position; and said spring causing said tensioning lever to bear against the first shaft part.

15. The shoe as claimed in claim 1, wherein the take-up drum is arranged above the tensioning lever.

16. The shoe as claimed in claim 1, wherein the first shaft part is pivotable about an axis which runs parallel to the sole of the shoe.

* * * * *